United States Patent [19]

Baker

[11] Patent Number: 4,526,227

[45] Date of Patent: Jul. 2, 1985

[54] SPOT THERMAL OR ENVIRONMENTAL CONDITIONER

[75] Inventor: Gary C. Baker, Jonesboro, Ark.

[73] Assignee: William B. Hurt, Jonesboro, Ark. ; a part interest

[21] Appl. No.: 516,644

[22] Filed: Jul. 25, 1983

Related U.S. Application Data

[63] Continuation-in-part of Ser. No. 405,437, Aug. 5, 1982.

[51] Int. Cl.[3] ..... F24B 1/06

[52] U.S. Cl. ..... 165/124; 98/34.6; 165/48 R; 165/139

[58] Field of Search ..... 165/108, 122, 123, 124, 165/126, 127, 139, 48 R, 37; 98/33 R, 33 A, 29; 62/298

[56] References Cited

U.S. PATENT DOCUMENTS

| | | | |
|---|---|---|---|
| 2,275,295 | 3/1942 | Greenway | 165/123 |
| 2,363,839 | 11/1944 | Demuth | 98/33 A |
| 2,633,070 | 3/1953 | Gillham | 165/124 |
| 3,172,463 | 3/1965 | Bowman | 165/2 |
| 3,477,502 | 11/1969 | Katz | 165/122 |
| 3,900,301 | 8/1975 | Constantinescu et al. | 165/124 |
| 3,973,479 | 8/1976 | Whiteley | 98/33 A |
| 4,100,764 | 7/1978 | Murano | 62/298 |
| 4,152,973 | 5/1979 | Petersen | 98/33 A |
| 4,255,176 | 3/1981 | Macrow | 98/33 A |

FOREIGN PATENT DOCUMENTS

| | | | |
|---|---|---|---|
| 669667 | 12/1938 | Fed. Rep. of Germany | 98/33 R |
| 2816669 | 10/1979 | Fed. Rep. of Germany | 98/33 A |
| 82039 | 7/1978 | Japan | 98/33 A |
| WO82/00337 | 2/1982 | PCT Int'l Appl. | 98/33 A |

*Primary Examiner*—Edward G. Favors
*Assistant Examiner*—Steven E. Warner
*Attorney, Agent, or Firm*—King, Liles and Schickli

[57] ABSTRACT

A spot thermal conditioning apparatus selectively operable in warming and cooling modes includes a housing containing three blowers or fans. One of the blowers receives warm ceiling air and projects an exiting stream of the ceiling air to a conditioning compartment within the housing. A fan receives the exiting ceiling air blower stream and concurrently draws a stream of cool floor air into the compartment. The mixed air is then expelled by the fan through a louver to provide directional control of the movement of the conditioned air mass and circulation of air to an open spot work area. An additional fan or blower is provided for circulating warm ceiling air through the housing and returning it back toward the ceiling separately from the flow of warm ceiling air moved by the other blower. The apparatus also includes a closed, heat exchange system and an air flow direction control plate. Additionally, an electronic speed control circuit is provided to allow completely independent operation of each blower and fan.

6 Claims, 35 Drawing Figures

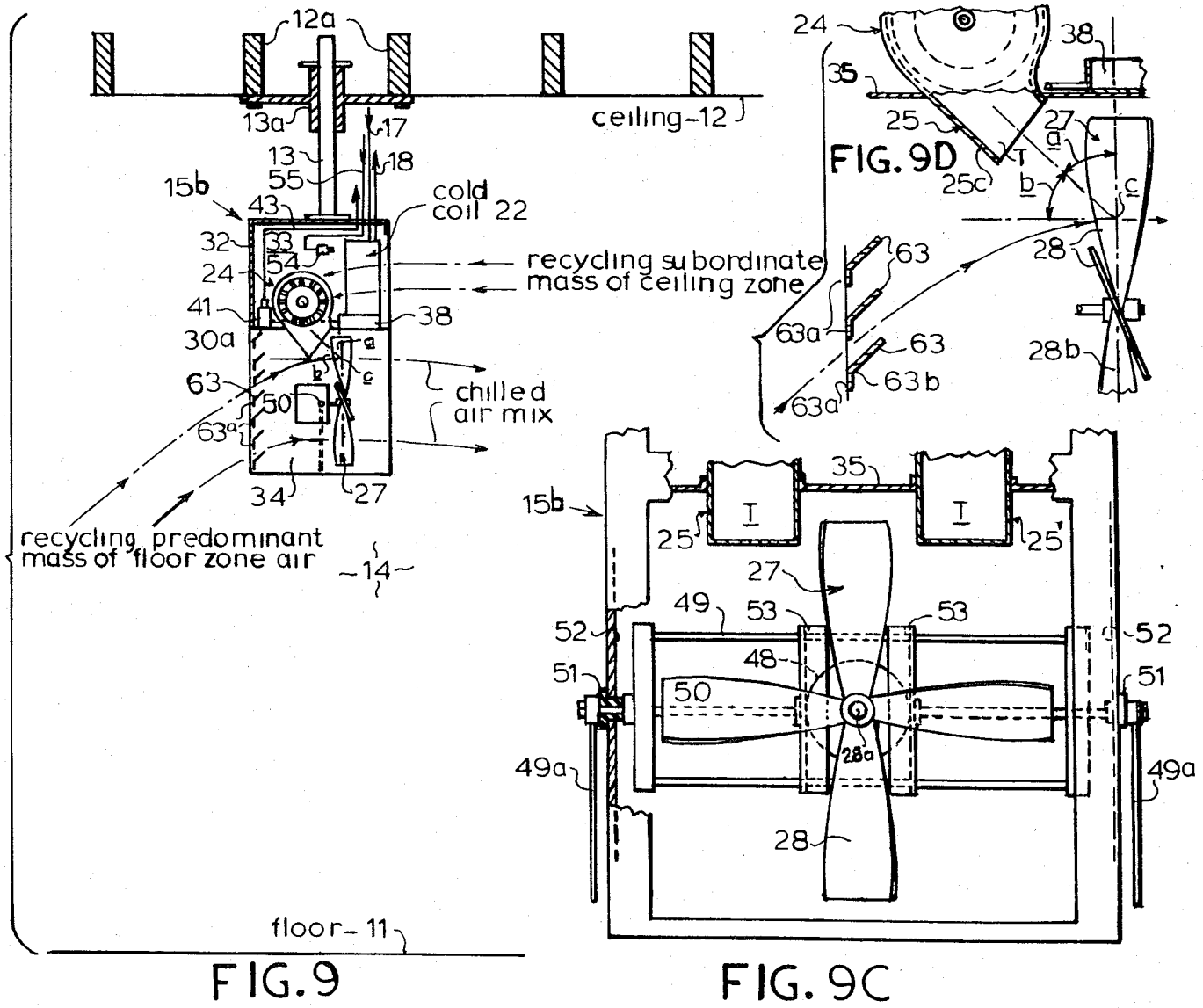
FIG. 9D
FIG. 9C
FIG. 9
ceiling-12
recycling subordinate mass of ceiling zone
cold coil 22
chilled air mix
recycling predominant mass of floor zone air
floor-11
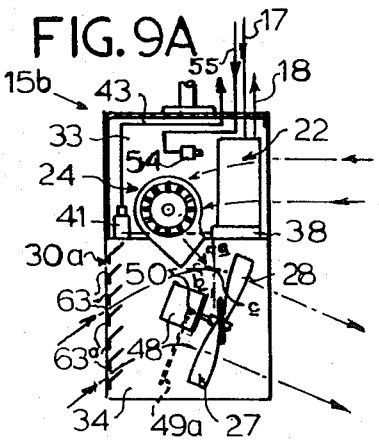
FIG. 9A
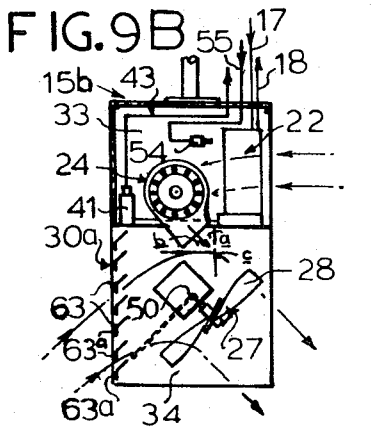
FIG. 9B ventilating fan
70°-80°F; 0.4 KWH ceiling fan
60°-70°F; 0.1KWH dehumidfier
80°F & above; 0.7KWH air conditioner-
80°-90°F; 2.0 KWH air heater-
50°-60°F; 2.0 KWH humidifier-
60°F. & below; 0.7kwh wind chiller-
90°-100°F; 2.3 kwh space warmer-
40°-50°F; 4.5 kwh air particle filter-
visible elements; 0.1kwh space chiller-
100°F & above; 2.5 kwh space heater-
40°F. & below; 4.6 kwh air pollution filter-
invisible elements;
0.1 kwh FIG. 13
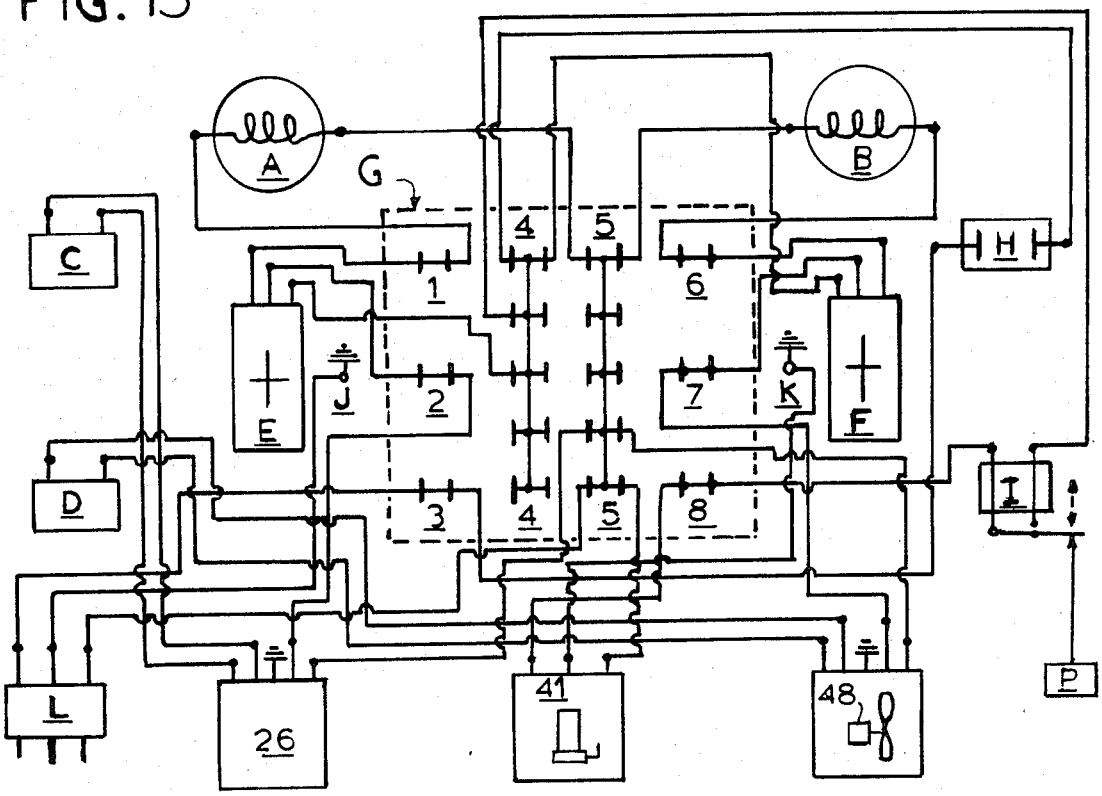
LEGEND:
A = Blower Pilot Light
B = Fan Pilot Light
C = Blower Capacitor
D = Fan Capacitor
E = Blower Speed Control
F = Fan Speed Control
G = Terminal Block
H = Main Power Fuse
I = Pump Float Switch
J = Power Cord Ground
K = Condensate Pump Ground
L = Power Plug
26 = Blower Motor
41 = Condensate Pump Motor
48 = Fan Motor
P = Float Mechanism
FIG. 14
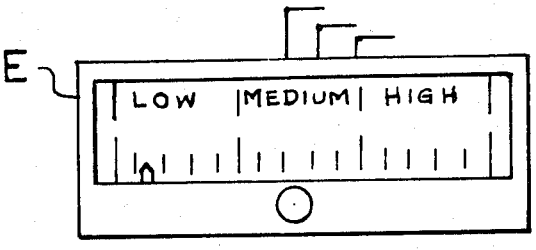
FIG. 15
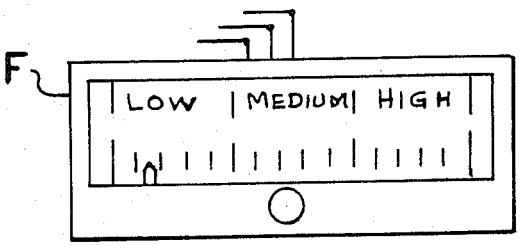
FIG. 16

SPOT THERMAL OR ENVIRONMENTAL CONDITIONER

RELATED APPLICATION

This is a continuation-in-part application of my application Ser. No. 405,437, filed Aug. 5, 1982.

BACKGROUND OF THE INVENTION

This invention relates to air mixing and ventilating devices and more especially thermal and environmental conditioning apparatus adapted to provide a comfortable spot environment for workers in relatively large substantially unenclosed industrial plants normally subjected to temperatures in the work areas that are usually higher than those on the exterior and which cannot be satisfactorily warmed or cooled in a practical and economical manner.

Heretofore, numerous types of devices have been provided for warming and cooling the entire space of a closed area or room by randomly mixing or homogenizing the upper level ceiling zone air with the lower level floor zone air and then discharging the resultant air mixture into the room. U.S. Pat. Nos. 2,275,295, 3,172,463, 3,973,479 and 4,152,973 to Greenway, Bowman, Whiteley and Peterson, respectively, are typical examples of such prior art devices which require considerably more time to provide a comfortable environment than would be required to spot condition the area. Where a large substantially unenclosed space is used by industrial workers, the time and expense required to comfortably condition the entire space is usually prohibitive. So far as applicant is aware, prior art devices do not provide spot wind chill envelopes or work areas during cooling stages by injecting a controlled mass of supplementary refrigerated air into a relatively large mass of recycling cool floor air to form a cold/cool air mixture and then propelling the mixture at prescribed velocities upon a recipient in a work area; nor is applicant aware of a prior art device for providing a spot warming effect during warming stages by injecting a controlled amount of supplementary heated air into a relatively large mass of recycling warm ceiling air and then propelling the resultant air mixture upon the recipient. Furthermore, such prior art is not believed to provide means for varying the ratio between the upper and lower recycling air masses in the resulting mixture whereby predominantly warm upper level air will be utilized during a warming mode and predominantly cool lower level air during the cooling mode.

In the heating and air conditioning field, several principles of thermodynamics and basic physical laws have been the catalyst for inventions devised to provide ventilation, cooling, heating, destratification, humidifying and air cleaning. These functions have been combined in several devices to provide two or more additional functions either simultaneously or singularly. In practice, such devices have one thing in common, namely, they are designed to work more efficiently in an enclosed area, with the possible exception of a conventional fan often used for spot ventilation and/or cooling. Furthermore, these devices have proven to be less efficient and less desirable comfortwise, especially when the area in which they are normally used is open to a hostile surrounding temperature. This drawback is due to the fact that the devices accomplish their thermodynamic functions through a process of time in an enclosed area and, as such, are less applicable for use in a spot area that is constantly exposed to a hostile surrounding temperature environment that cannot be economically enclosed or sealed.

It is with the above-mentioned limitations of conventional environmental conditioning apparatus in mind that a more complete understanding of the principles of thermodynamics is thus proposed as the basis for my improved spot thermal conditioning device. The present invention is designed, constructed and arranged in accordance with some basic physical laws embodied in a dual thermal air circulation loop disposed between the ceiling and floor of a building structure, operates selectively as a multifunctional apparatus that is efficient, simple in construction, and relatively inexpensive to manufacture, and offers a level of thermal conditioning heretofore not available in any single device to the best of applicant's knowledge and belief.

The dual thermal loop is composed of a vertically disposed upper ceiling zone circuit around which warm ceiling air flows, and a second vertically disposed floor zone circuit around which relatively cool floor air flows, the lower arcuate portion of the upper circuit intersecting the upper arcuate portion of the lower circuit at an acute angle to form a conditioned air mixture which is then propelled to a spot work area in the floor zone.

It is therefore an object of this invention to provide a spot thermal and environmental conditioning apparatus that is constructed and arranged to function as set forth in the abstract of the disclosure and discussed in the related comments above.

It is a further object of invention to provide a spot air conditioning apparatus of the class described wherein a focused mass or stream of ceiling zone air of one thermal temperature level is injected into a mass or stream of floor zone air of a substantially different temperature level without producing appreciable diffusion and thermal wind shear at the point of intersection whereby the mass of injected air is caused to remain tightly focused within the floor air throughout the travel of the mixture to the work area.

It is yet another object of invention to provide a spot thermal air conditioning apparatus as set forth in the immediately preceding paragraph, in combination with means selectively operable to dehumidify, to humidify, to filter visible particles or to filter polluted invisible particles from the ceiling zone air immediately preceding its focused injection into and its mixture with the floor zone air.

BRIEF DESCRIPTION OF THE DRAWING

Some of the objects of invention having been stated, other objects will appear as the description proceeds when taken in connection with the accompanying drawings, in which.

FIG. 9 is a modified form of the invention similar to FIG. 7, but showing a pivoted fan assembly adjusted to produce a long-throw, high-mass, cool-air circulation of the air mixture emanating therefrom;

FIG. 9A is a view similar to FIG. 9, but with the fan assembly adjusted to produce a medium-throw, high-mass, cool-air circulation;

FIG. 9B is a view similar to FIG. 9, but with the fan assembly adjusted to produce a short-throw, medium mass, cool-air circulation;

FIG. 9C is an enlarged front elevation of the lower portion of FIG. 9 and with certain portions thereof shown in section;

FIG. 9D is an enlarged sectional detail view of the intermediate portion of FIG. 9;

FIG. 13 is a block circuit wiring diagram for the invention;

FIG. 14 is a legend of the components shown in FIG. 13;

FIG. 15 is an elevation of a control dial for the main fan assembly 27, illustrating low, medium and high speed adjustable settings;

FIG. 16 is an elevation of a control dial for the blower or blowers 24, 24', illustrating low, medium and high speed adjustable settings;

DETAILED DESCRIPTION OF THE PREFERRED EMBODIMENT

Figure 2:
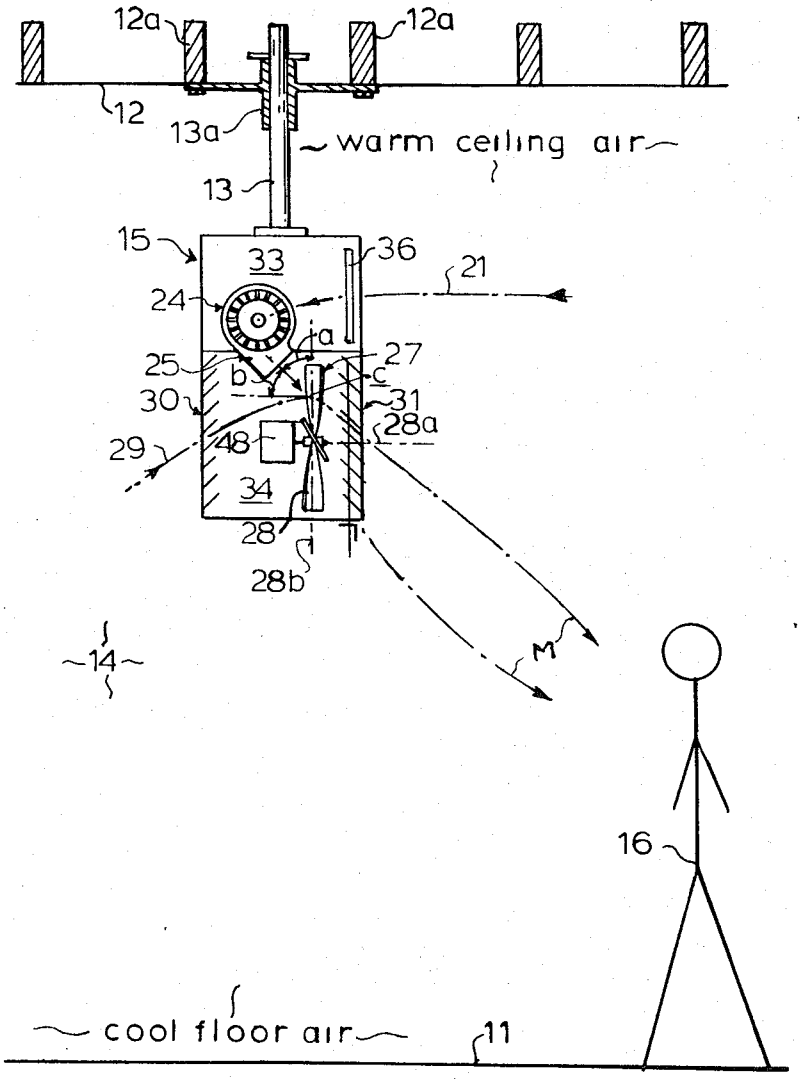
FIG. 2 is a more detailed view showing a structural unit embodying the components in FIG. 1 when suspended from the ceiling of a building structure.

Applicant's base proportional air mixing and spot discharging module or unit 15 comprises the components shown in the upper and lower thermal air circuits 21 and 29 of FIGS. 1, 2 and 8 and is briefly described below:

I. a vertically disposed ceiling zone circuit 21 containing first air flowing means including (a) air blower or blowers 24, 24' including motor 26 for providing a flow of ceiling air into upper compartment 33 and transmitting it through air scoop or scoops 25, 25' into lower compartment 34, and II. a vertically disposed floor zone loop or circuit 29 having its upper arcuate portion intersecting the lowermost arcuate portion of upper circuit 21 at an acute angle a of approximately 45°. The fan assembly 27 forms a second air flowing means where the ceiling and floor air masses mix. The scoops 25, 25' focus the blower air into the floor air at the intersections c while shielding the blower air from the upstream floor air thereby limiting the thermal wind shear that could result between the intersecting air streams of different temperature levels. The fan assembly 27 is capable of providing a CFM (cubic feet per minute) under a load of approximately 2 to 10 times the CFM of the blower or blowers 24, 24', said floor zone circuit also containing (a) a back louver frame 30 having a plurality of spaced baffle boards or slats 63 each positioned substantially at an angle of 45 degrees relative to a horizontal plane to cause the floor zone air to be drawn upwardly and laterally by the fan 27 to said intersections and mixed with the ceiling zone air exiting from the blower, and (b) an adjustable front louver frame 31 for guiding the air mixture from the fan 27 laterally and downwardly at selected acute angles into a spot work area occupied by a person.

The base module 15 is rotatably suspended in space 14 from ceiling joists 12*a*, 12*a* by means of shaft 13 and bracket 13*a*.

During the warming mode when a higher floor zone spot temperature for a worker is desired, a predominant mass of ambient warm ceiling air is recycled at various blower settings (FIG. 16) in a counterclockwise direction in upper circuit 21, through the blower 24, 24' and into the fan blades 28; and concurrently, a subordinate mass of ambient cool floor zone air is recycled at various fan settings (FIG. 16) in a clockwise direction in lower circuit 29, through back louver 30 to the fan blades 28 where the predominant warm ceiling air is injected by scoops 25, 25' into the subordinate floor air to form an air mixture M having a higher temperature than that of the cool ambient floor air. The mixture is then propelled laterally and downwardly through front louver 31 to a selected spot work area 16 surrounded by ambient floor zone air.

During the cooling mode when a lower floor zone spot temperature is desired by the occupant of the work area, a predominant mass of ambient cool floor zone air is recycled at various fan settings (FIG. 16) and in a clockwise direction in lower circuit 29, through louver 30 and into the fan blades 28; and concurrently, a subordinate mass of ambient warm ceiling zone air is recycled in a counterclockwise direction in upper circuit 21, through blowers 24, 24', scoops 25, 25' where the exiting blower air is focused and injected into the fan blades 28 where it is mixed with the recycling predominant cool floor air to form an air mixture having a lower temperature than that of the ambient ceiling air. The mixture is then propelled by the fan, through front louver 31 and to spot work area 16.

By changing the speed control settings E and F for the blower 24 and fan 27, respectively, as shown in FIGS. 14–16, the ratio between the recycling masses of ceiling and floor air may be varied to provide an air mixture M suitable to the comfort of the recipient in work area 16.

Figure 1:
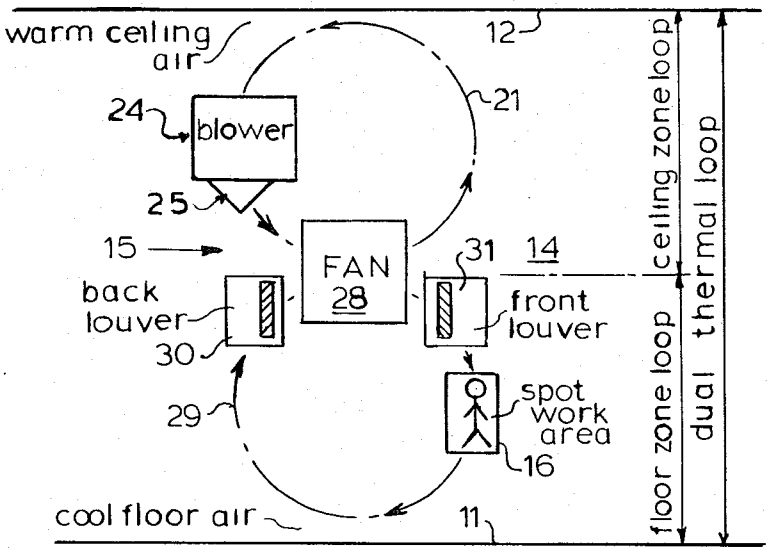
FIG. 1 is a schematic view of a basic thermal loop comprising intersecting ceiling and floor zone air loops, and showing the components in each loop according to my invention.
Figure 4:
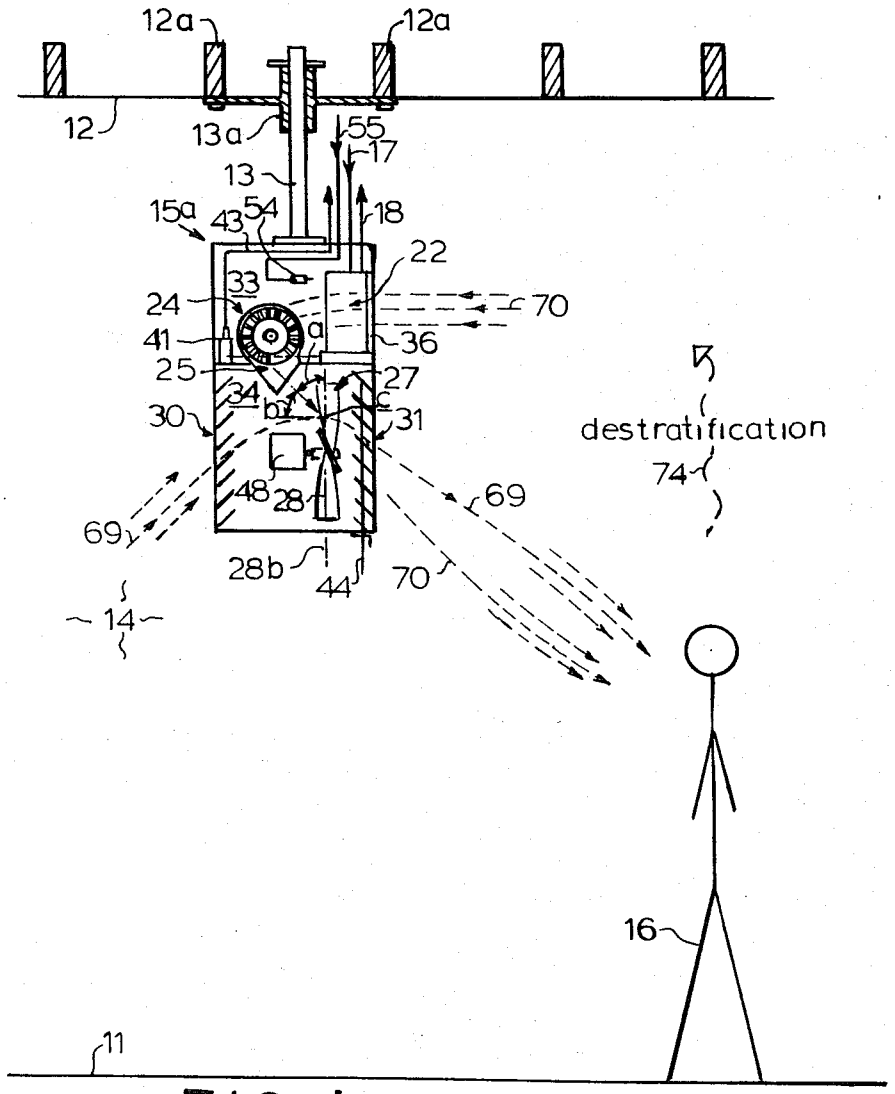
FIG. 4 is a schematic view of the structural arrangement of the components shown in FIG. 3 when suspended from the ceiling of a building structure.
Figure 3:
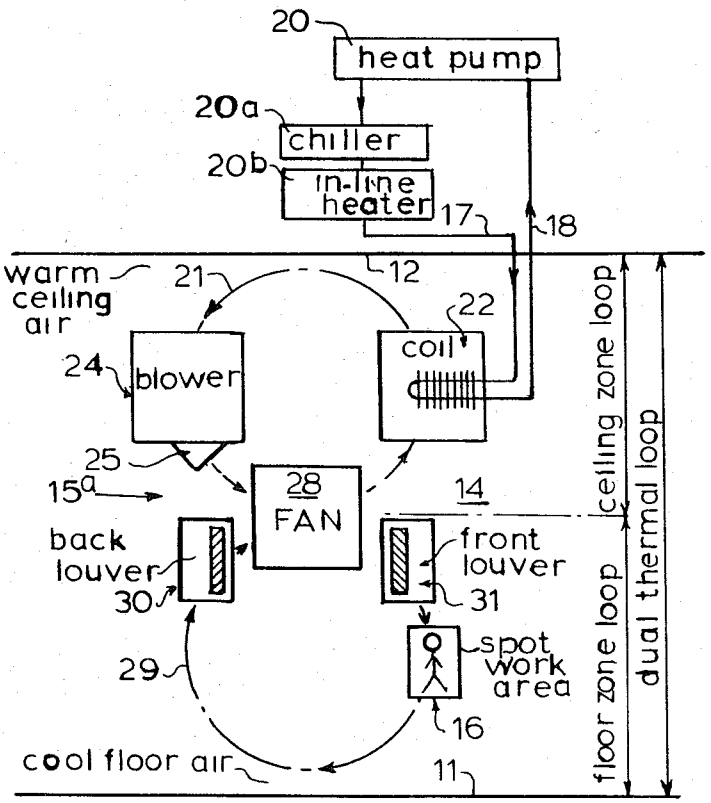
FIG. 3 is a schematic view of the dual thermal loop shown in FIGS. 1 and 2 in combination with a finned-tube coil through which a heat transer fluid is adapted to flow to further cool or warm the ambient ceiling zone air flowing thereover.

FIGS. 3 and 4 are substantially identical to previously described FIGS. 1 and 2 respectively, except for the addition of a device, such as heat pump 20, capable of furnishing supplementary hot or cold fluid on demand to finned-tube coil 22, the latter being installed in upper circuit 21.

During the warming mode when it is desired to raise the spot air temperature in work area 16 above that of the ambient subordinate floor zone air, supplementary hot fluid is circulated through coil 22 to boost or raise the temperature of the predominantly warm ceiling air then flowing over the coil 22, through blower 24 and into mixture M.

During the cooling mode when it is desired to lower the spot air temperature in work area 16 below that of the ambient predominant floor zone air, supplementary cold fluid is circulated through coil 22 to lower the temperature of the subordinate warm ceiling zone air to a temperature below that of the predominantly cool ambient floor zone air. Then, the low-temperature ceiling air flows through blower 24 and into mixture M.

Applicant employs a chiller **20*a* and an in-line heater 20*b* which are connected in series with heat pump 20 and coil 22 by means of pipes 17 and 18** through which water is circulated as a heat transfer fluid in a well known manner.

Figure 6:
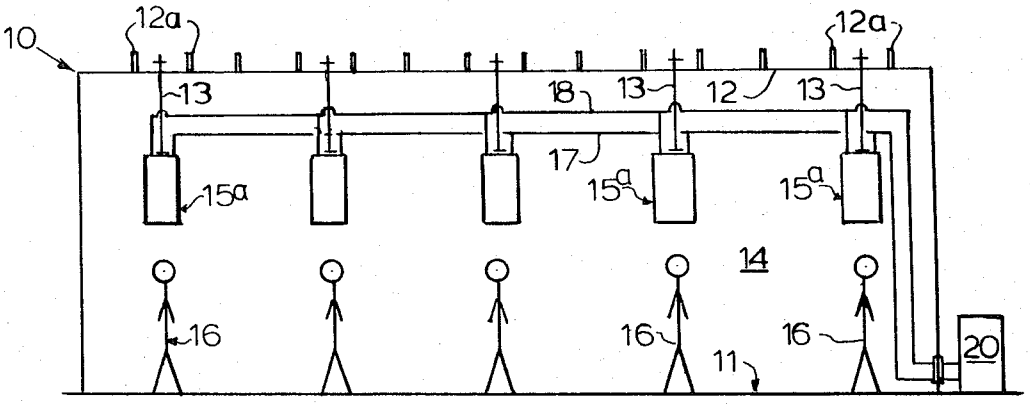
FIG. 6 is a schematic elevational view taken along line 6—6 in FIG. 5.
Figure 5:
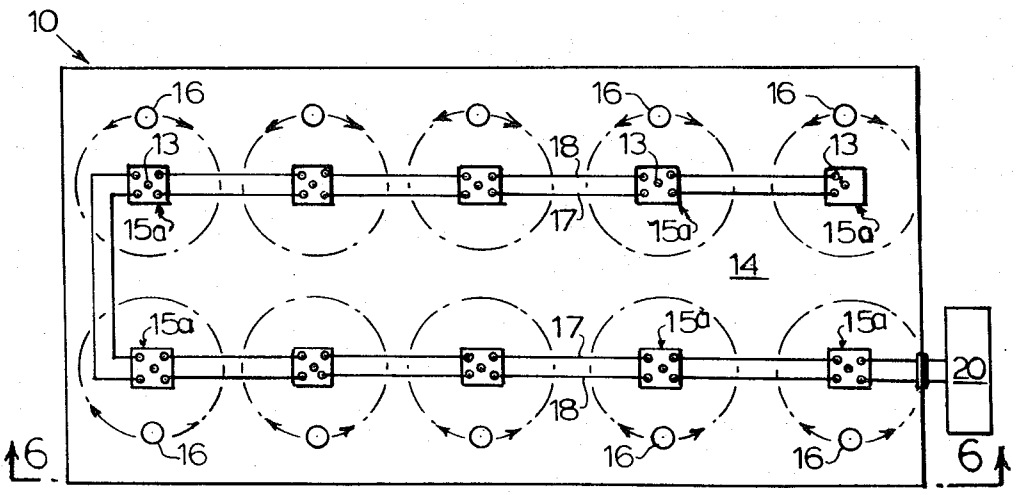
FIG. 5 is a schematic plan view of an industrial building equipped with a plurality of interconnected spot environmental units such as structurally illustrated in FIG. 4.

Referring to FIGS. 5 and 6, the numeral 10 denotes a substantially unenclosed building structure such as a factory, warehouse, machine shop, welding shop or factory and having an occupancy area 14 normally subjected to outside temperatures during winter and summer seasons and which cannot be comfortably warmed or cooled economically. The structure 10 has a floor 11 and a ceiling 12 which limit the vertical movement of the air in the space 14 therebetween, said space having module **15*a* suspended therein in the same manner as described in connection with base module 15 and shown in FIG. 2**.

As illustrated in FIGS. 5 and 6, a plurality of modules **15*a* are suitably situated in the substantially unenclosed building structure 10 and at work areas 16 where spot air conditioning is required, each of said modules being provided with the finned-tube coil 22** and a system for furnishing supplementary hot or cold fluid to the coil, previously described.

The term "thermal stages" as hereafter used in the specification is to be construed as the average indoor temperature of the spot work area unless otherwise specified; and the electrical use stated in kilowatt hours (KWH) is to be construed as the maximum power consumption of the primary and secondary items.

Figure 7A:
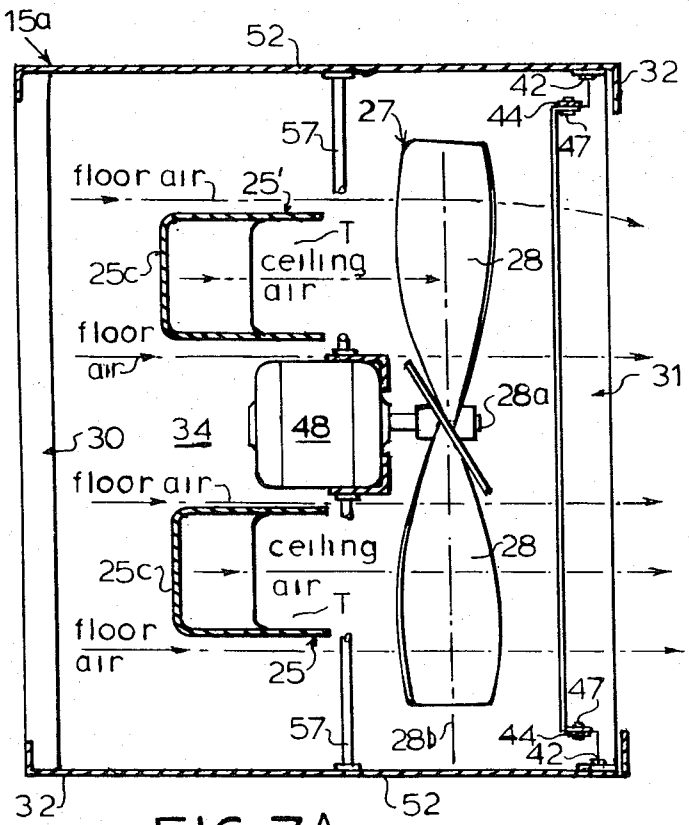
FIG. 7A is a sectional plan view taken along line 7A—7A in FIGS. 7 and 8, showing the air flow pattern at the intersection of the ceiling and floor zone thermal loops.
Figure 7:
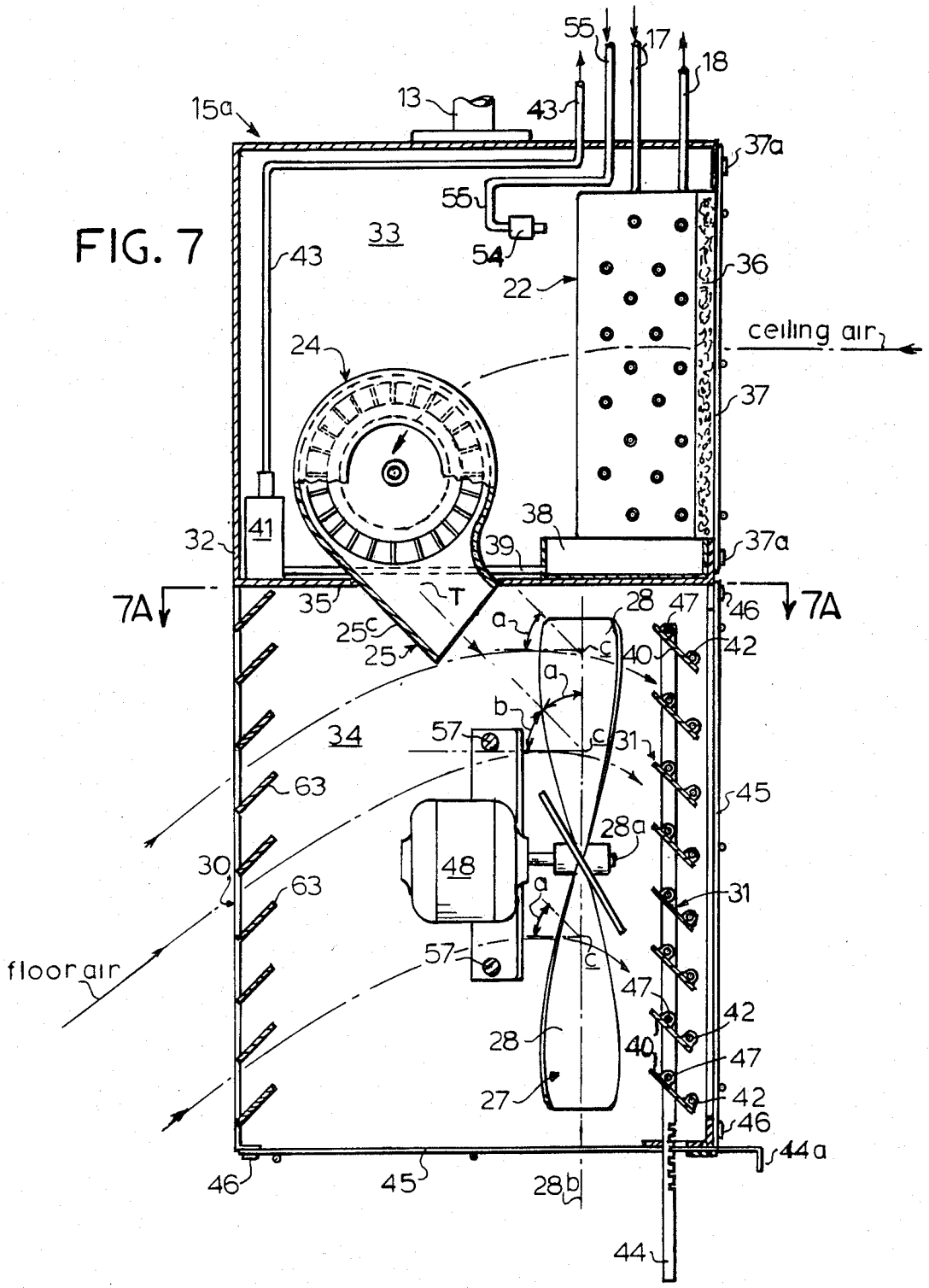
FIG. 7 is an enlarged vertical sectional view showing the structural components of FIG. 3.
Figure 8:
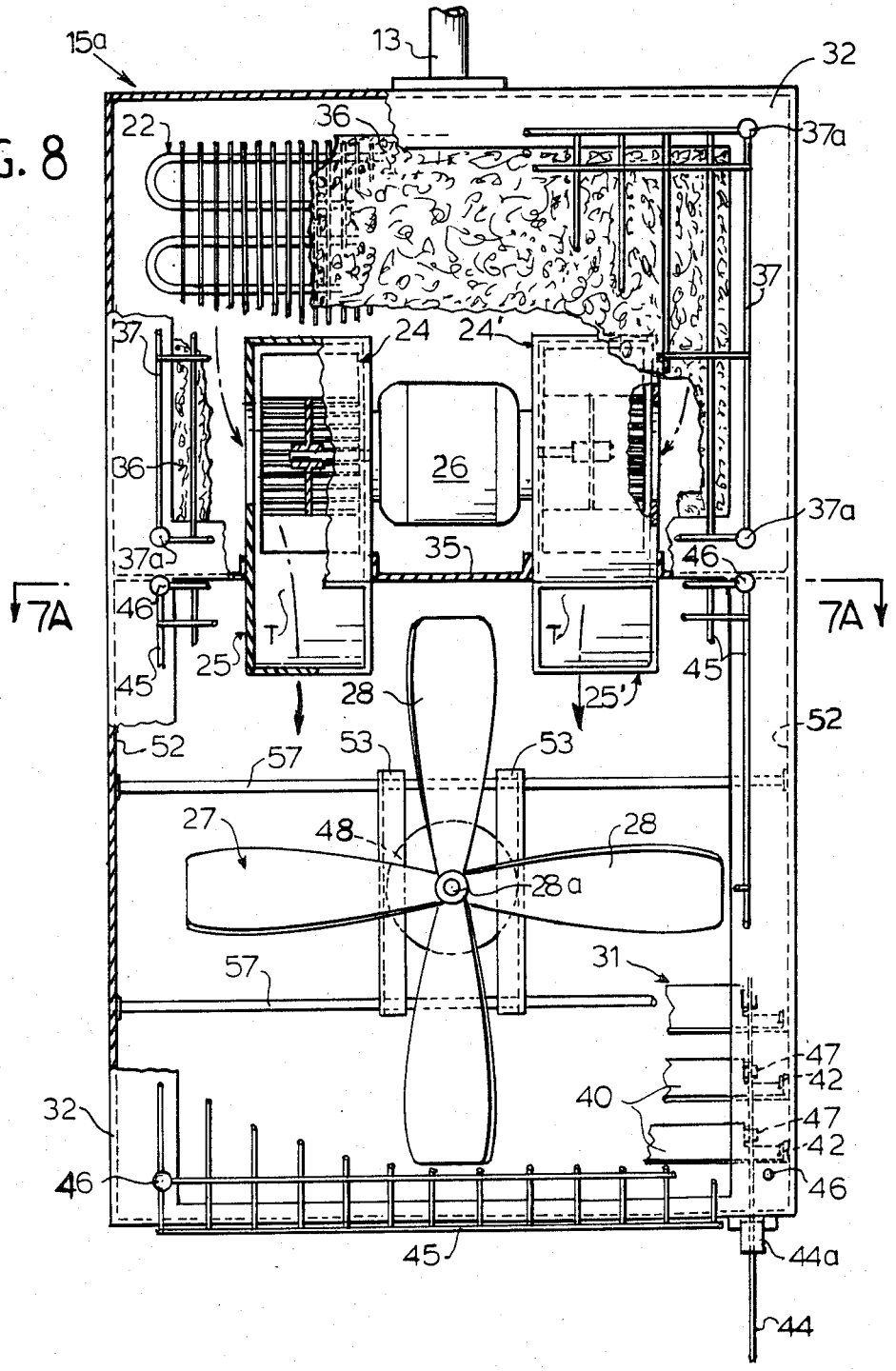
FIG. 8 is a front view looking at the right-hand side of FIG. 7, certain parts being broken away and other parts shown in section for purposes of illustration.
Figure 10:
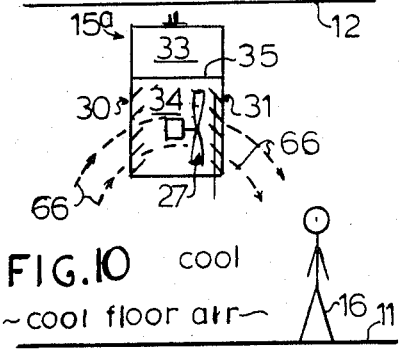
FIGS. 10 and 10A through 10C are schematic views illustrating typical floor and ceiling air zone circulation patterns during progressively increasing temperature ranges of the cooling mode.

The structural organization of the components schematically shown in FIGS. 3 and 4 is best shown in FIGS. 7, 7A and 8 wherein the numeral 32 denotes the chassis or frame of unit **15*a*, said chassis having a closed upper compartment 33 and a relatively open lower compartment 34, the compartments being separated by a floor or partition 35. The finned-tube coil 22 and a filter 36 are mounted in the front side of compartment 33 while blowers 24 and 24' and their common motor 26 are mounted in the rear of the compartment upon the floor 35**.

The filter 36 is removably confined against the fins of coil 22 by an open grill 37 secured as a **37*a* to chassis 32. Beneath coil 22 and mounted upon floor 35 is a drip pan 38 adapted to collect the condensate or other liquid accumulation draining from the coil, said pan having a drain pipe 39 leading therefrom to a pump 41 which, in turn, has a second pipe 43 leading therefrom and adapted to conduct the condensate to the exterior of unit 15*a***.

An atomizer 54 is mounted in upper compartment 33 adjacent coil 22, said atomizer having a water supply line 55. When humidification becomes necessary, the atomizer 54 sprays coil 22 with a short pulse, at which time the sprayed water evaporates into the air as the latter flows over the coil and into compartment 33. The moistened air then flows through blowers 24, 24', through scoops 25, 25', into lower compartment 34, and to fan 27 where it is mixed with lower level floor air and propelled to the work area 16, as further described in connection with FIG. 12A.

The lower compartment 34 has the louver frame 30 mounted in its back side, a pair of forwardly extending side walls 52, 52 and open front and bottom sides covered by adjacent legs of an L-shaped open grill 45, said grill 45 being attached to chassis 32 as at 46 (FIG. 7). The back louver frame 30 consists of a plurality of spaced slats or baffles 63 fixedly secured therein and pitched rearwardly and downwardly preferably at an acute angle of 45 degrees relative to a horizontal plane. The front open side of compartment 34 has a louver frame 31 mounted therein comprising spaced slats 40, each of said slats having its opposite ends mounted for oscillation about fixed coaxial pivots 42, 42. In order to vary the pitch of slats 40, a vertically disposed handle bar 44 is pivoted as at 47 to each slat at a point disposed eccentrically of said coaxial fixed pivots 42, 42 whereby vertical reciprocation of the bar will effect simultaneous oscillation of all of the slats 40 in the louver to open or close the spaces therebetween. A suitable latch means **44*a* is provided on chassis 32** and adapted to be manipulated to hold the slats at selected angular pitched positions for reasons later described.

The motor 48 of fan assembly 27 is fixedly mounted in the air-mixing area of compartment 34 and between the side walls 52, 52 of the latter by any suitable means such as vertically spaced horizontal rods 57, 57, each rod having its opposite ends secured said side walls 52, 52 (FIGS. 7 and 8). A pair of laterally spaced and vertically disposed angle members 53, 53 are secured to the opposite sides of motor 48 and to the intermediate portions of rods 57, 57 to secure the fan assembly 27 in a fixed position within compartment 34, below blower scoops 25, 25', and between back and front louvers 30 and 31 respectively.

As previously mentioned and as best shown in FIGS. 7, 7A and 8, a stream of upper level ceiling air flows downwardly from blowers 24, 24', through their respective scoops 25, 25', and at an acute angle of intersection b into an incoming stream of lower level ambient floor zone air of lower loop or circuit 29. The fan blades 28 are located substantially at said intersection where the upper and lower level streams of different temperature levels mix. The upper level ceiling air stream exits from each of the scoops at an acute angle a with the vertical plane 28*b* whch contains the fan blades 28.

It is important to note that each of the scoops 25, 25' cooperates with its associated blower 24, 24' to form a restricted outlet as at T which lowers the pressure and increases the speed of the air flowing through the scoops 25, 25' to provide a venturi effect. Moreover, each scoop 25, 25' is constructed and arranged to prevent the exiting blower air stream from being sheared off of its focused course of intersection into fan blades 28 by the incoming lower level floor air concurrently moving along circuit 29, through back louver 30 and into compartment 34. Such shearing, if not prevented, would dilute the focusing effect necessary for proper injection of the blower air thereby retarding efficient air mixing by the fan blades 28. Accordingly, each of the scoops 25, 25' is arranged so as to penetrate the incoming floor air stream a short distance upstream of the intake side of the fan blades 28 and with the inclined back surface 25*c* of the scoop 25, 25' lying in the path of and serving as a baffle for the floor air (FIGS. 7 and 7A). In this position, each scoop 25, 25' performs a dual function, namely, (1) as an air nozzle for the focused blower air, and (2) as a shield for limiting the thermal wind shear between the exiting blower air and the incoming floor air. As previously stated, the ceiling or blower air and the floor air are of different thermal temperature levels which tend to promote objectionable air diffusion and wind shear at the exit points of the scoops 25, 25' unless properly limited.

More particularly and as best shown in FIG. 7A, the recycling ceiling air enters compartment 34 from scoops 25, 25' in two streams which are focused against fan blades 28 at points disposed eccentrically of the fan axis 28*a*. At the same time, the recycling lower level floor air flows into the compartment toward the back side of each scoop where the stream is shunted on each side of the scoop as well as on each side of the upper level air exiting from the scoop. In other words, the incoming floor zone air stream is subdivided by scoops 25, 25' into three segments, one segment flowing between the scoops 25, 25', another between scoop 25 and the proximate side wall 52, and the other between scoop 25' and the other proximate side wall 52. With each of the floor zone air segments flowing in separate paths from the focused ceiling air streams at the intake side of fan blades 28, air shifting, diffusion and wind shear between the ceiling and floor air streams of different thermal temperature levels will be dramatically reduced. Therefore, beginning with the initial injection of the blower air streams into fan blades 28 and throughout the travel of the combined streams into the envelope or work area 16, the blower air streams as modified by the above-described venturi effect will remain tightly focused within the main air stream projected by the fan.

FIGS. 9, 9A, 9B and 9C show a modified unit 15*a* for directing the conditioned air laterally and downwardly from the fan blocks 28 to selected work areas 16 located at various distances from the unit. Instead of employing the previously described front louver frame 31 to accomplish this purpose, the modified embodiment provides means for mounting the entire fan assembly 27 for limited back-and-forth movement about aligned axles 50, 50 of a rectangular cradle or frame 49, said axles being journaled in friction bearings 51, 51 which, in turn, are mounted in side walls 52, 52 of lower compartment 34 respectively.

An operating handle 49*a* is secured to the outer end of each of said axles 50 whereby the cradle 49 and fan assembly 27 may be rotated to vary the angular pitch of the conditioned air mixture traveling to work area 16. The friction bearings 51, 51 yieldably resist movement of the cradle and the fan assembly 27 in either direction from any selected angular position. FIG. 9 shows the fan assembly 27 adjusted to produce a long-throw, high-mass, cool-air circulation, whereas, FIGS. 9A and 9B show the fan assembly 27 adjusted to produce a medium-throw, high-mass, cool-air circulation and a short-throw, medium-mass, cool-air circulation, respectively. It is evident that the fan may be adjusted to any intermediate angular position between the examples described above.

The modified form of mechanism shown in FIGS 9–9D is provided with a back louver frame 30*a* which is identical to previously described louver frame 30, except for the addition of a short vertically disposed flange 63*a* to the lower edge of each louver board 63 as best shown in FIG. 9D. Flanges 63 and 63*a* diverge from one another at an obtuse angle thereby forming a re-entrant trench 63*b* therebetween which functions in a semi-parabolic fashion to produce a pronounced downward curvature of the lower level air stream as it enters compartment 34 and merges at intersection c with the air streams exiting from blower scoops 25, 25', thereby substantially reducing diffusion and wind shear as described in connection with the previous embodiment of invention.

Figure 10A:
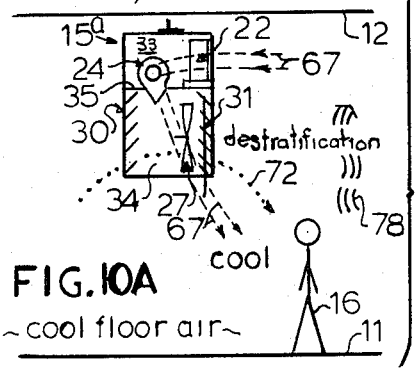
Figure 10B:
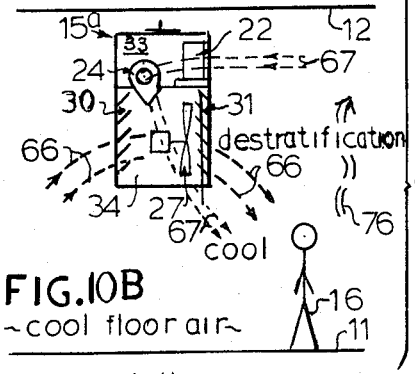
Figure 10C:
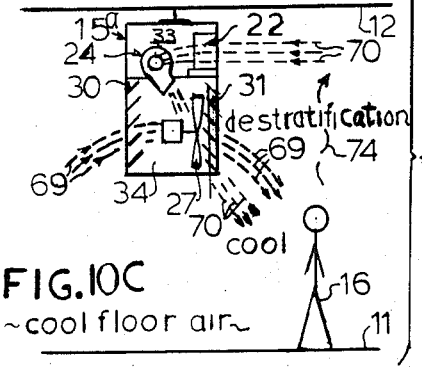

FIGS. 10 through 12C show typical air circulation patterns for several of the respective multifunctional uses of the invention. In these Figures, different types and combinations of types of line arrows are used to designate electronic blower and fan settings and directions of air movement during the cooling, warming and conditioning stages briefly described below:

- a single dashed arrow line 65 (FIGS. 11–11A and 12–12C) designates the direction of air flow resulting from low blower CFM settings from 0% to 33% (FIGS. 13–16);
- twin dashed arrow lines 66, 66 (FIGS. 10 and 10B) designate the direction of air flow resulting from medium fan CFM settings of 34% to 66%;
- twin dashed arrow lines 67, 67 (FIGS. 10A, 10B and 11B) indicate the direction of air flow resulting from medium blower CFM settings of 34% to 66%;
- triple dashed arrow lines 69 (FIG. 10C indicate the direction of air flow resulting from high fan CFM settings of 67% to 100%;
- triple dashed arrow lines 70 (FIGS. 10C and 11C) indicate the direction of air flow resulting from high blower CFM settings of 67% to 100%;
- a single dotted arrow line 72 (FIGS. 10A and 11C) indicates the direction of air flow resulting from autorotation of the fan with induced air injection from the blower;

a single interrupted sinuous or serpentine arrow line 74 (FIG. 10C) indicates high destratification of heat rise during air cooling functions;

twin interrupted serpentine arrow lines 76 (FIG. 10B) indicate medium destratification of heat rise during air cooling functions, and triple interrupted serpentine arrow lines 78 (FIG. 10A) indicate low destratification of heat rise during air cooling functions.

COOLING STAGES

In the cooling mode, the invention relies heavily on the cooler floor zone air as the highest mass of recycled air during which it is selectively operable as a ventilator, an air conditioner, a wind chiller and a space chiller while using applicable fan and blower settings (See FIGS. 10 and 10A–10C, 15.)

More particularly, in a temperature range of approximately 70 to 80 degrees F. of the cooling stages, the invention functions as a ventilator with only the main fan of assembly 27 operating, and with the electronic blower speed control E in OFF position. The electronic fan speed control F is adjusted to a medium setting as indicated by dashed arrow line 66 thereby causing the fan to pull low level air upwardly through back louver frame 30, into chamber 34, and then to project it through front louver frame 31 to work area 16 therebelow—using 0.4 KWH.

In the approximate temperature range of 80 to 90 degrees F., the invention functions as an air conditioner (FIG. 10A). With the electronic fan speed control F in OFF position, the blower speed control E is adjusted to a medium setting as indicated by twin dashed arrow lines 67 thereby causing blowers 24, 24' to pull the upper level destratified air over cold coil 22 and then project it through scoops 25, 25' into lower compartment 34 to cause the fan of assembly 27 to autorotate some low level air into the compartment as indicated by dotted arrow line 72. Both upper and lower level air masses are then mixed and projected to the recipient in work area 16 therebelow—using 2.0 KWH. Thus, the upper level air heat rise becomes destratified as indicated by the triple interrupted serpentine arrow lines 78.

In the approximate temperature range of 90 to 100 degrees F., the invention functions as a wind chiller (FIG. 10B). With the blower speed control E on a medium setting as indicated by twin dashed arrow lines 66, and with the fan speed control F also on a medium setting as indicated by twin dashed arrow lines 67, the blowers 24, 24' pull the upper level destratified air indicated by the arrow lines 67 over cold coil 22 and then propel it through scoops 25, 25' into lower compartment 34. At the same time, the fan blades 28 of assembly 27 pulls lower level air upwardly through back louver frame 30, between scoops 25, 25' and into the fan blades as previously described. The air masses from the blower and from the lower level are then mixed and transferred to work area 16 therebelow—using 2.3 KWH. Thus, in the upper level air the heat rise is subjected to destratification as indicated by twin interrupted serpentine arrow lines 76.

In the approximate temperature range of 100 degrees F. and above, the invention functions as a space chiller as shown in FIG. 10C. With the blower and fan speed controls E and F each adjusted to a high setting, the blowers 24, 24' pull the upper level destratified air over cold coil 22 as indicated by triple dashed arrow lines 70 and then propels it through scoops 25, 25' into compartment 34. At the same time, the fan blades 28 pull the lower level air indicated by triple dashed arrow lines 69 into compartment 34 where both air masses are mixed, after which the mixture is transferred to work area 16 therebelow—using 2.5 KWH. The rising heat becomes destratified as indicated by the single interrupted serpentine arrow line 74.

WARMING STAGES

Figure 11:
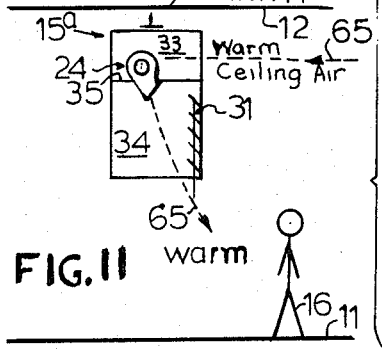
FIGS. 11 and 11A through 11C are schematic views illustrating typical floor and ceiling air zone circulation patterns during progressively decreasing temperature ranges of the warming mode.
Figure 11A:
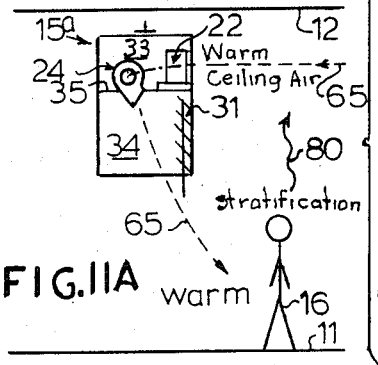
Figure 11B:
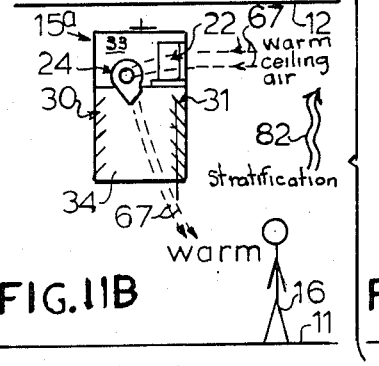
Figure 11C:
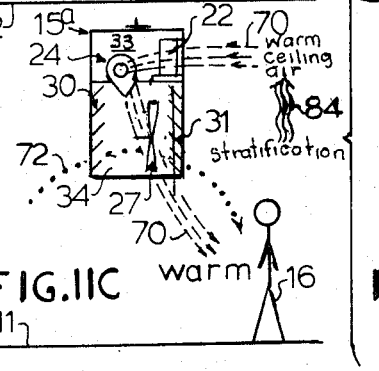

During warming stages, the invention is selectively operable as a ceiling fan, an air heater, a space warmer and a space heater as shown in FIGS. 11 through 11C and while relying heavily on the warmer ceiling zone air as the highest mass of recycled air.

In the temperature range of approximately 60 to 70 degrees F., the invention functions as a ceiling fan as shown in FIG. 11, at which time, only the blowers 24, 24' operate. With the electronic fan speed control F in OFF position, the electronic blower control E is adjusted to a low setting (FIG. 16), causing the upper level stratified heat to be pulled into the blowers 24, 24' and subsequently discharged through scoops 25, 25' through compartment 34 to the work area 16—using 0.1 KWH.

In the temperature range of approximately 50 to 60 degrees F., the invention functions as an air heater as shown in FIG. 11A, at which time, the blowers 24, 24' operate substantially in the same manner as when operating as a ceiling fan, but with blower control E adjusted to a low setting while a hot heat transfer fluid flows through coil 22, thereby causing the upper level stratified air indicated by the single dashed arrow line 65 to be drawn over hot coil 22, through scoops 25, 25', into compartment 34 from whence it flows to work area 16—using 2.0 KWH.

In the temperature range of approximately 40 to 50 degrees F. the invention functions as a space warmer as shown in FIG. 11B, at which time, the hot heat transfer fluid flows through coil 22 while the blowers 24, 24' operate under a medium setting of speed control E and while the fan speed control F is in OFF position. With these settings, the blowers pull the upper level air over hot coil 22 as indicated by the twin dashed line arrows 67 and propel it through scoops 25, 25' into compartment 34, causing the fan of assembly 27 to autorotate some lower level air into the compartment where the air masses are mixed and then transferred to the work area 16—using 4.5 KWH. The heat rise adds to increased stratification as indicated by twin uninterrupted serpentine arrow lines 82. Also, the heat elements included in the primary heat transfer fluid source are activated.

In the approximate range of 40 degrees F. and below, the invention functions as a space heater as shown in FIG. 11C, at which time the blowers 24, 24' pull upper level stratified heat over hot coil 22 and project it through scoops 25, 25' into compartment 34, causing the main fan of assembly 27 to autorotate some low level air into the compartment where the upper and lower level air masses are mixed and subsequently transferred to work area 16—using 4.6 KWH. The heat rise stratifies, heat elements included in the primary heat transfer source activate, and the water condenser superheater included in the primary heat pump freon circuit engages.

CONDITIONING STAGES

During the conditioning stages, the invention is adapted to selectively operate as a dehumidifier, a humidifier, an air particle filter and as an air pollution filter as described below.

In all standard air conditioning systems when in a cooling or heat removal mode and when the humidity level is sufficient to cause condensation (i.e., water formation) on the evaporator coil, it becomes necessary to remove the condensation. If a simple gravity removal system is not practical, it is a standard practice to employ suitable means such as the tray or pan 38 below coil 22 together with a water pump 41 to lift the condensate from the pan 38 (FIGS. 7, 13 and 14). A float mechanism P is attached to a vertical rod (not shown) which, in turn, is attached to electrical ON switch I, said switch being vertically movable to sense a certain level of water in the pan 38, thereby providing a float switch mechanism to activate pump 41 as needed.

Figure 12:
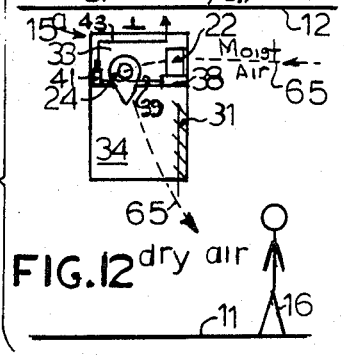
FIGS. 12 and 12A through 12C are schematic views illustrating the invention as selectively used in the conditioning stages of dehumidification, humidification and air filtration.

In the cooling mode and as the blowers pull moist ambient air over the cold finned-tube coil 22, the condensation from the moisture-laden air will form on the coil 22 and subsequently drain into the pan 38 thereby activating the float mechanism P at a predetermined high liquid level to initiate removal by pump 41 through drain line 43 as previously described (FIG. 7). Thus, a percentage of the moisture is removed from the air while passing through the coil 22 so that dryer-than-ambient dehumidified air will be projected upon the recipient in the work area. (FIG. 12).

Figure 12A:
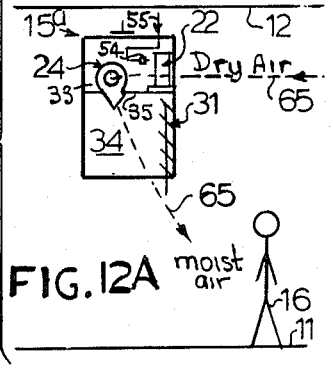

In the warming mode and as the blowers 24, 24' pull relatively dry air (i.e., dryer than normal air produced by standard heating practices or by low humidity climates) through the hot finned-tube coil 22, the water atomized by spray nozzle 54 (FIG. 7) is projected upon the coil 22 as previously described thereby evaporating the resulting water spray into the air streams entering blowers 24, 24' which, in turn, project the moisture laden air through scoops 25, 25', into the blades 28 and subsequently upon the recipient in work area 16. (FIG. 12A).

Figure 12B:
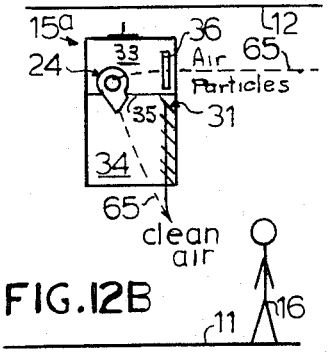

In all air movement modes except the ventilation function previously described and as the blowers 24, 24' pull particle laden air through the cellular or fibrous filter 36 placed in front of coil 22 (FIG. 7), the cells or fibers in the filter 36 will trap a high percentage of visible particles such as dust, oil, crystalized chemicals and the like before entering the coil 22 or blower 24, 24' thereby removing most of the visible particles and provide cleaner air in the work area 16 (FIG. 12B).

Figure 12C:
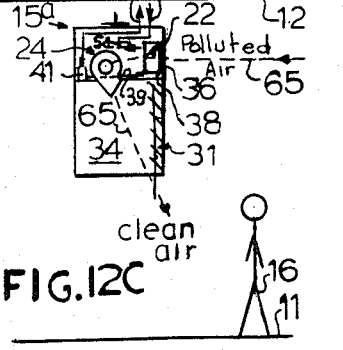

In all cooling air movement modes (except the ventilation function illustrated in FIG. 10), when sufficient humididy levels are present to promote formation of condensation on the finned-tube coil 22 or when water is sprayed onto the coil 22 by the atomizer nozzle 54 during the humidification stage, the blowers 24, 24' pull polluted air over the moist coil 22. Since the moisture on the coil 22 has a characteristic disposition to dissolve and dilute most non-liquid properties into a liquid state, the moisture will trap a substantial percentage of pollutants that are invisible to the human eye (e.g., gases, micro-particles and the like) before entering the blowers. The amount of moisture trapped will depend upon the existing moisture-to-air ratio. Thus, significant amounts of invisible pollutants in a given air stream induced by the blowers 24, 24' will be removed so as to provide the work area 16 with cleaner air (FIG. 12C).

Figure 21:
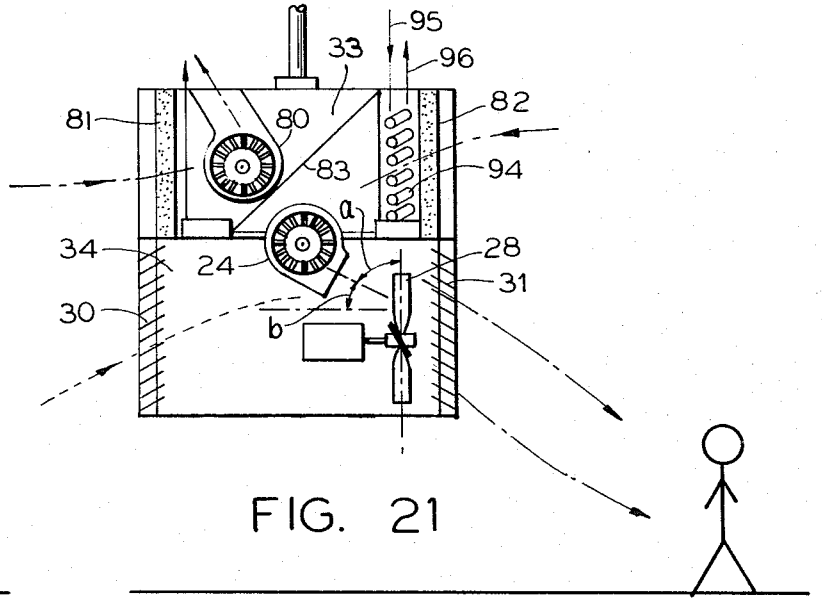
FIG. 21 is a schematic view of the structural arrangement of components including a second means for flowing a warm mass of air and including filtering devices and a coil in heat exchanging relation with the air moved by the first means for flowing a mass of air.
Figure 19:
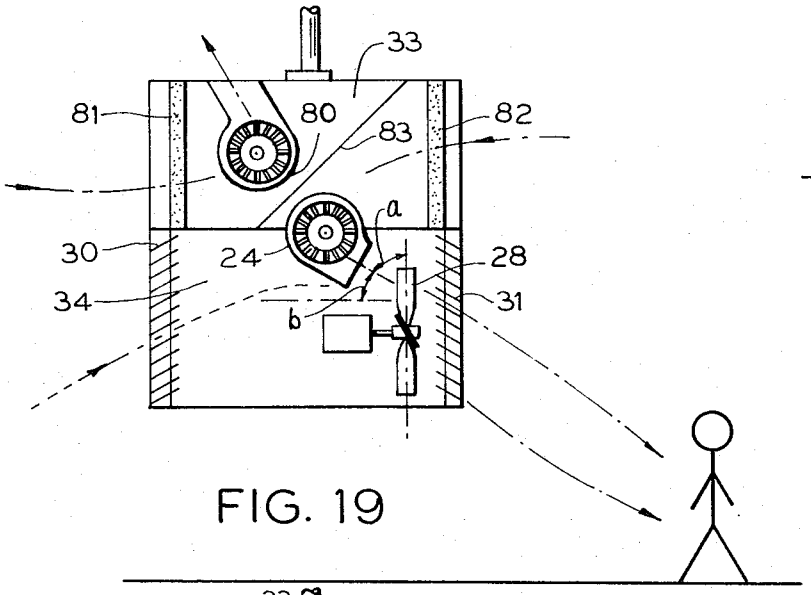
FIG. 19 is a schematic view of the structural arrangement of components including a second means for flowing a warm mass of air through the upper compartment of the device of the present invention and impelling the air upwardly toward the ceiling but separately from the first means for flowing a warm mass of air and also including air filtering devices for improving the quality of air moved from the compartment to the desired zone.
Figure 20:
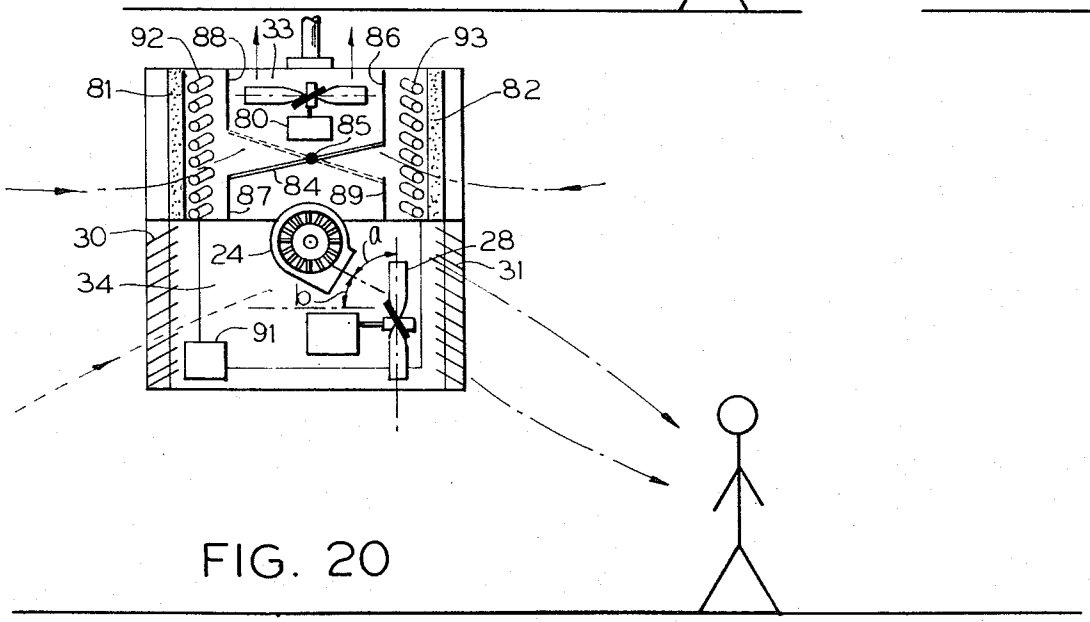
FIG. 20 is a schematic view of the structural arrangement of components including a second means for flowing a warm mass of air and including a closed heat exchange system and air filtering devices.

With reference now to FIGS. 19, 20, and 21 preferred embodiments of the invention are shown. In these embodiments a third air blower or fan 80 is positioned within upper compartment 33 for moving a third mass of relatively warm ceiling air of the work space or occupancy area and directing the air through an air filtration device 81. Air moved through the upper compartment by the first air blower 24 passes through an air filtration device 82. The embodiments are especially useful for conditioning air and delivering the air to a work zone located in a large building wherein inordinately high amounts of air borne particles or pollutants are present.

In FIG. 19 air blower 80 is positioned in the upper compartment of the device of the present invention. This blower causes the relatively warmer air nearer the ceiling of the building to move through air filtration device 81 and to be discharged upwardly toward the ceiling. Blower 24 moves warm air nearer the ceiling of the building through air filtration device 82 but, in this case, to be discharged into lower compartment 34 where fan 28 causes the air to be mixed with relatively cooler air drawn into lower compartment 34 through back louver frame 30 in the manner above-described and to be discharged through adjustable front louver frame 31 in the appropriately selected direction. Partition 83 is diagonally positioned within upper compartment 33 so that the circuit of air moved by blower 80 is separate from the circuit of air moved by blower 24.

In FIG. 20 air blower or fan 80 is positioned in upper compartment 33 which is provided with a back filter 81 and a front filter 82. The fan causes part of the air moved through the upper compartment 33 to move through a filter device to be discharged in an upwardly direction toward the ceiling. A diverter plate 84 is pivotably mounted at point 85. As shown in FIG. 20, the plate is positioned so that its ends sealably contact walls 86 and 87. The plate can be rotated to the position denoted by the broken line so as to sealably contact walls 88 and 89. Thus, the circuit of air moved by blower 80 is separate from the circuit of air moved by blower 24.

In the lower compartment a fluid compressor 91 is located which is part of a closed heat exchange system comprising condenser coil 92 and evaporator coil 93, associated together with suitable conduits and control means. The air moved by blower 24 is discharged into lower compartment 34 where fan 28 causes the air to be mixed with cooler air drawn into lower compartment 34 through back louver frame 30 in the manner above-described and to be discharged through adjustable front louver frame 31 in the appropriately selected direction. In the heating mode plate 84 is set to the position denoted by the broken line. Air is brought into the upper compartment 33 through filter 81 across heating coil 92 and discharged by blower 24 into compartment 34. When the plate is set, blower 80 causes air to move through filter 82 across cooling coil 93 and to be discharged from the compartment upwardly toward the ceiling. In the cooling mode plate 84 is set to be positioned in the manner illustrated in FIG. 20. Air is brought into the upper compartment 33 through filter 82 across cooling coil 93 and discharged by blower 24 into compartment 34. When the plate is so set, blower 80 causes air to move through filter 81 across heating coil 92 and to be discharged from the compartment upwardly toward the ceiling.

In FIG. 21 air blower 80 causes the warm air nearer the ceiling to move through air filtration device 81 and to be discharged upwardly toward the ceiling. Blower 24 moves warm air nearer the ceiling of the building through air filtration device 82 across a fluid heat exchange coil 94. The fluid is brought to and from the upper compartment by means of conduits 95 and 96. The air impelled by blower 24 is discharged into lower compartment 34 where fan 28 causes the air to mix with cooler air drawn into lower compartment 34 through back louver frame 30 in the manner above-described and to be discharged through adjustable front louver frame 31 in the appropriately selected direction. Partition 83 is diagonally positioned within upper compartment 33 so that the circuit of air moved by blower 80 is separate from the circuit of air moved by blower 24.

Figure 18:
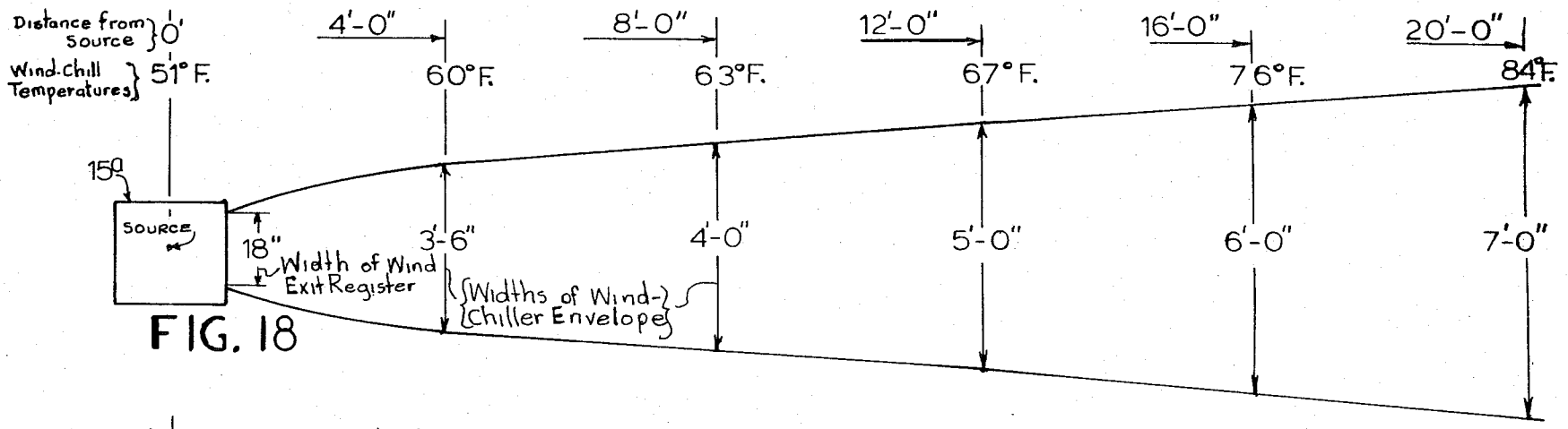
FIG. 18 is a schematic plan view o FIG. 17.
Figure 17:
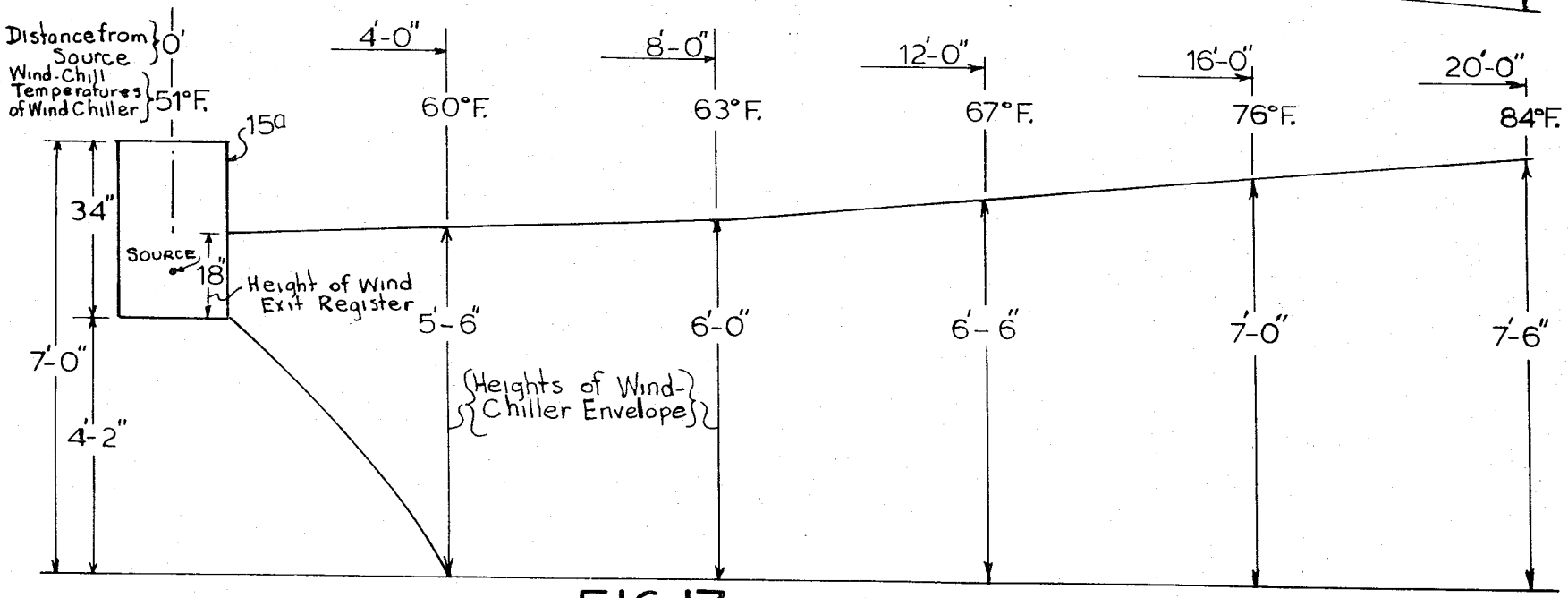
FIG. 17 is a schematic elevational view showing dimensions and temperatures of a conditioned envelope or work area when the invention functions as a wind chiller as shown in FIG. 10B.

A series of tests were conducted with a full-scale prototype of the invention disclosed above in several different areas simulating actual use in order to verify the operational characteristics. FIGS. 17 and 18 show the results of a test in an open area of a large unobstructed building of approximately 12,000 square feet of floor space, with an average ceiling height of 14 feet, without any ceiling or wall insulation, and without any nearby walls or other internal obstructions to trap air movement from the prototype. The bottom of unit 15 was disposed 4 feet 2 inches above the floor and its front louver frame or register was adjusted to aim the projected air horizontally forwardly.

The test was conducted at an indoor ambient temperature of 90 degrees F. and a relative humidity of between 50 and 60 percent. The main test instrument was a special wind chill meter manufactured under the trademark RAIN-WISE, INC., Bar Harbor, Maine.

The wind chill meter consisted of two (thermocouple) thermometers, one of which indicated the "still" air temperature, and the other, the wind chill (convective) temperature in relation to the ability of the moving air to dissipate heat electrically applied to the moving air (thermocouple) thermometer over an interval of 5 to 10 minutes in accordance with the manufacturer's instructions. It should be noted that this method of reading wind chill in terms of heat dissipation (i.e., convection) is a different method of measurement that can allow warmer than usual wind chill temperature factors, when compared with the more common method of calculating wind chill via the ambient "still" air temperature as it relates to the relative air stream velocity.

In summary, the test convincingly demonstrates the potential of the prototype to dissipate surface heat (i.e., thermocouple or body heat) by injection of colder than ambient air into a stream of higher velocity lower level indoor ambient air, and then projecting this cold-cool air mix into a tight high velocity air stream focused on a recipient with an effective frontal projection range of up to 20 feet maximum in length measured from the air exit register, and with $1\frac{1}{2}$ to $7\frac{1}{2}$ feet in width (2 to 4 feet high being prime chest/head area), $7\frac{1}{2}$ feet high, and with wind chill (convective) temperature readings (not dry-bulb) increasing from 51 degrees F. at the register to 84 degrees F. over the 20 feet of length, as shown in FIGS. 17 and 18. All wind chill measurements were taken at the center of each distance limit within the air envelope.

GENERAL CONTROL OPERATION

Cool or Warm Air Injection

To increase the temperature (heating/warming modes), or to decrease the temperature (air conditioning/cooling modes), use the Electronic Blower Speed Control "E" to determine the RPM of the Blower Motor 26 which, in turn, determines the CFM of cold or hot air that is injected into the main Fan 27 and subsequently onto the person. For Fan 27 operation without a warming/cooling mode, leave control "E" in OFF position.

Autorotation or Energized Fan Activation

To increase the projected air velocity (air conditioning/cooling modes), use Electronic Fan Speed Control "F" to determine the RPM of the Fan Motor 48 which, in turn, determines the CFM of cool or warm air that is projected onto the person. For autorotation of Fan 27 during heating/warming modes, leave the Fan Speed Control "F" in OFF position.

Wind Chill Function

To operate the Environmental Conditioner in a Wind Chill mode, use the Electronic Blower Speed Control "E" to determine the CFM of cold air that is injected into Fan 27, and the Electronic Fan Speed Control "F" to determine the CFM of cool air that is projected onto the person. To achieve an effective wind chill function, adjust the Electronic Blower Speed Control "E" to a comfortable setting, and then adjust the Electronic Fan Speed Control "F" until a comfortable mix of cold conditioned air and of cool floor ambient air is projected onto the person. A typical wind chill mix could consist of a one-to-three wind chilling factor comprising one part of cold conditioned air from the blower 24 injected into three parts of lower level ambient air from fan 27 thereby providing a 25% chill factor. Thus 25% of the total 100% of projected air mass is cold conditioned air and 75% is cool lower level ambient air.

I claim:

1. In a building structure having a floor and a ceiling for limiting the vertical movement of the air in the space therebetween, the air temperature in a lower level floor zone of said space being lower than that in an upper level ceiling zone, and a housing having at least one compartment therein mounted substantially between said zones, a spot thermal conditioning apparatus selectively operable in warming and cooling modes, respectively, and comprising (a) a first means for flowing a first mass of said warmer ceiling zone air into said compartment;

(b) a second, independent means for concurrently flowing a second mass of said cooler floor zone air into the compartment, said first and second masses intersecting at an acute angle to form an air mixture having a temperature intermediate the temperature of the air in said ceiling and floor zones;

(c) means for varying the ratio between said flowing masses to cause predominantly warmer ceiling zone air and subordinately cooler floor zone air to be flown into said mixture during the warming mode and subordinately warmer ceiling zone air and predominantly cooler floor zone air to be flown into the mixture during the cooling mode;

(d) means for projecting a concentrated tightly focused, high velocity stream of said air mixture horizontally and downwardly from said compartment to an open spot work area substantially surrounded by said floor zone air; and (e) a third means for flowing a third mass of warmer ceiling zone air into said compartment and upwardly toward the ceiling in a separate circuit from the flow of air moved by the first means for flowing a mass of said warmer ceiling zone air.

2. The conditioning apparatus defined in claim 1 including at least one filtering device for filtering warmer ceiling air zone moved into the apparatus.

3. The conditioning apparatus defined in claim 1 including means for compressing a fluid, means forming a closed heat exchange system in said apparatus with said compressing means including a heated portion where said fluid is moved in heat exchanging relationship with one mass of air and a cool portion where fluid is moved in heat exchanging relationship with the other mass of air, means positioned between said first means and said third means for flowing a mass of ceiling zone air for adjustably directing during the cooling mode the air moving across the cool portion to the first means for flowing a mass of air and the air moving across the heated portion to the third means for flowing a mass of air and for adjustably directing during the heating mode the air moving across the heated portion to the first means for flowing a mass of air and the air moving across the cool portion to the third means for flowing a mass of air.

4. The conditioning apparatus defined in claim 3 including at least one filtering device for filtering warmer ceiling zone air moved into the apparatus.

5. The conditioning apparatus defined in claim 1 including means operable during the cooling mode for flowing supplementary cold heat transfer fluid through said heat exchange system to decrease the temperature of the air moved by the first means for flowing a mass of ceiling zone air and being operable during the heating mode for flowing supplementary hot heat transfer fluid through said coil to increase the temperature of the air moved by the first means for flowing a mass of ceiling zone air.

6. The conditioning apparatus defined in claim 5 including at least one filtering device for filtering warmer ceiling zone air moved into the apparatus.

* * * * *